US008641445B2

(12) United States Patent
Su et al.

(10) Patent No.: US 8,641,445 B2
(45) **Date of Patent: *Feb. 4, 2014**

(54) CABLE CONNECTOR ASSEMBLY WITH AN IMPROVED LIGHT PIPE

(75) Inventors: Ping-Sheng Su, New Taipei (TW); Hong-Jie Yu, Kunshan (CN); Dou-Feng Wu, Kunshan (CN); De-Gang Zhang, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 49 days.

This patent is subject to a terminal disclaimer.

(21) Appl. No.: 13/336,463

(22) Filed: Dec. 23, 2011

(65) Prior Publication Data

US 2012/0164875 A1 Jun. 28, 2012

(30) Foreign Application Priority Data

Dec. 24, 2010 (CN) ..... 2010 1 0605863

(51) Int. Cl.
*H01R 3/00* (2006.01)

(52) U.S. Cl.
USPC ..... 439/490; 439/76.1

(58) Field of Classification Search
USPC ..... 439/55, 76.1, 449, 488–490, 439/620.21–620.25
See application file for complete search history.

(56) References Cited

U.S. PATENT DOCUMENTS

| | | | | |
|---|---|---|---|---|
| 7,722,363 | B2 * | 5/2010 | Zhou et al. | 439/76.1 |
| 7,753,689 | B1 * | 7/2010 | Wu | 439/63 |
| 7,785,136 | B2 * | 8/2010 | Zhang et al. | 439/490 |
| 7,789,675 | B2 * | 9/2010 | Zhang et al. | 439/76.1 |
| 7,857,666 | B2 * | 12/2010 | Chen et al. | 439/675 |
| 8,011,935 | B2 * | 9/2011 | Ko | 439/76.1 |
| 8,333,608 | B2 * | 12/2012 | Ko | 439/490 |
| 2010/0015842 | A1 | 1/2010 | Zhang et al. | |

* cited by examiner

*Primary Examiner* — Thanh Tam Le

(74) *Attorney, Agent, or Firm* — Wei Te Chung; Ming Chieh Chang

(57) ABSTRACT

A cable connector assembly (100) comprises a mating member (3), a printed circuit board (2) with a LED (24), a cable (7) having a plurality of wires connected with the mating member, a light pipe (4) having a pair of protrusions (42) parallel to each other, and an insulative shell (1) enclosing the cable and the mating member. The protrusions are neighboring to the LED. The insulative shell is enclosing the printed circuit board, the cable and the mating member. Each protrusion has a leg portion (421) protruding forwards from a front end thereof, and the printed circuit board defines a pair of outlets (26) on opposite sides thereof to engage with the corresponding leg portions.

10 Claims, 5 Drawing Sheets

CABLE CONNECTOR ASSEMBLY WITH AN IMPROVED LIGHT PIPE

BACKGROUND OF THE INVENTION

1. Field of the Invention

The present invention generally relates to a cable connector assembly, and more particularly to a cable connector assembly transmitting power signal.

2. Description of Related Art

Nowadays, cable connector assemblies are widely used in an electronic equipment, especially for transmitting power, and the performance of the cable connector assembly directly impacts on the entire electronic equipment whether can normally run.

U.S. patent Pub. No. 20100015842 A1 discloses a conventional cable connector assembly, the cable connector assembly comprises a printed circuit board, a Light Emitting Diode (LED) attached to the printed circuit board to indicate the working status of the cable connector assembly, a light pipe receiving the LED, a cable with a plurality of wires, a plurality of contacts connected with the cable, a columnar mating member, and an insulated shell enclosing the printed circuit board, the LED, the light pipe and the mating member partially. While an inner insulator molded, the melted plastic material may promote the light pipe rotating or moving as the light pipe has a round external surface, and the rotating or moving of the light pipe may hit the LED, thus the broken LED can't indicate the working status of the cable connector assembly.

Hence, it is desirable to have an improved structure to overcome the above-mentioned disadvantages of the prior art.

BRIEF SUMMARY OF THE INVENTION

Accordingly, the object of the present invention is to provide a cable connector assembly with an improved light pipe.

In order to achieve the above-mentioned object, a cable connector assembly in accordance with the present invention comprises a mating member, a printed circuit board with a LED, a cable having a plurality of wires connected with the mating member, a light pipe having a pair of protrusions parallel to each other, and an insulative shell enclosing the cable and the mating member. The protrusions are neighboring to the LED. The insulative shell is enclosing the printed circuit board, the cable and the mating member. Each protrusion has a leg portion protruding forwards from a front end thereof, and the printed circuit board defines a pair of outlets on opposite sides thereof to engage with the corresponding leg portions.

Other objects, advantages and novel features of the invention will become more apparent from the following detailed description of the present embodiment when taken in conjunction with the accompanying drawings.

DETAILED DESCRIPTION OF THE INVENTION

Figure 1:
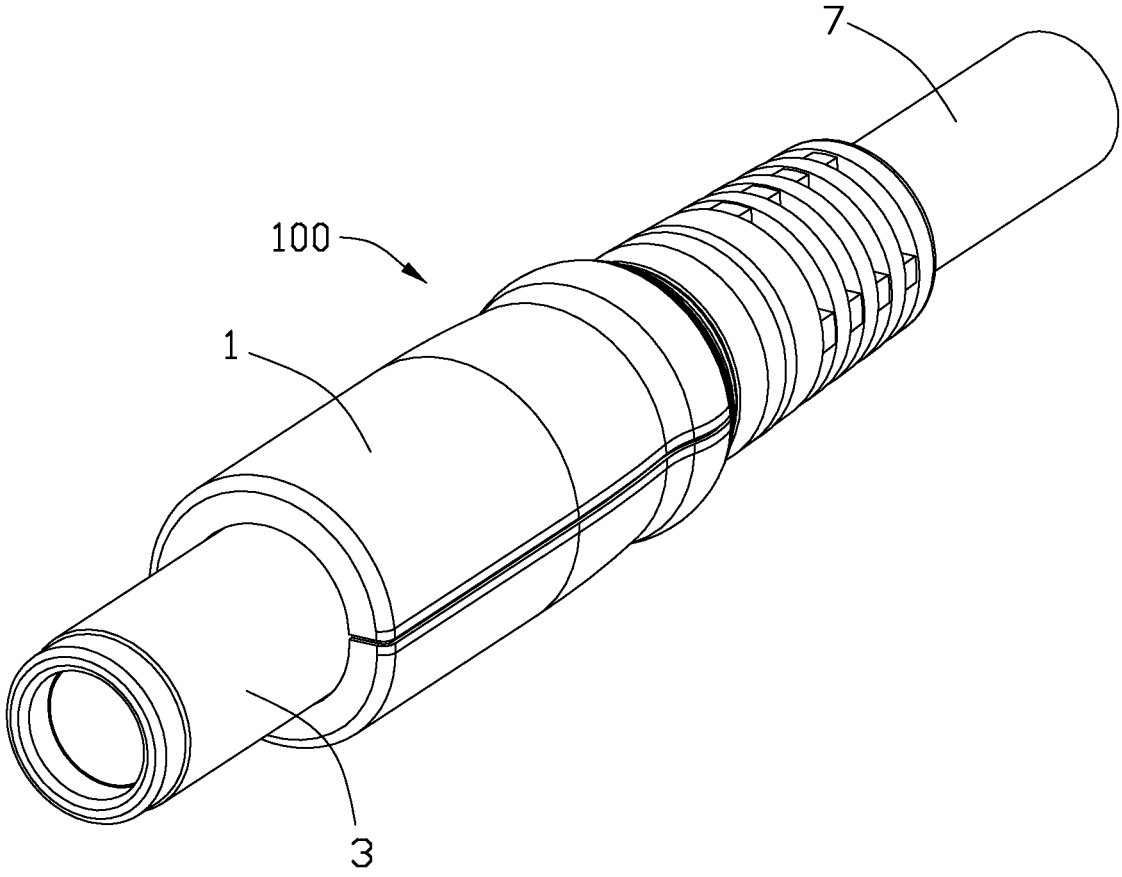
FIG. 1 is an assembled perspective view of a cable connector assembly in accordance with the present invention.

Reference will now be made to the drawing figures to describe the present invention in detail.

Figure 2:
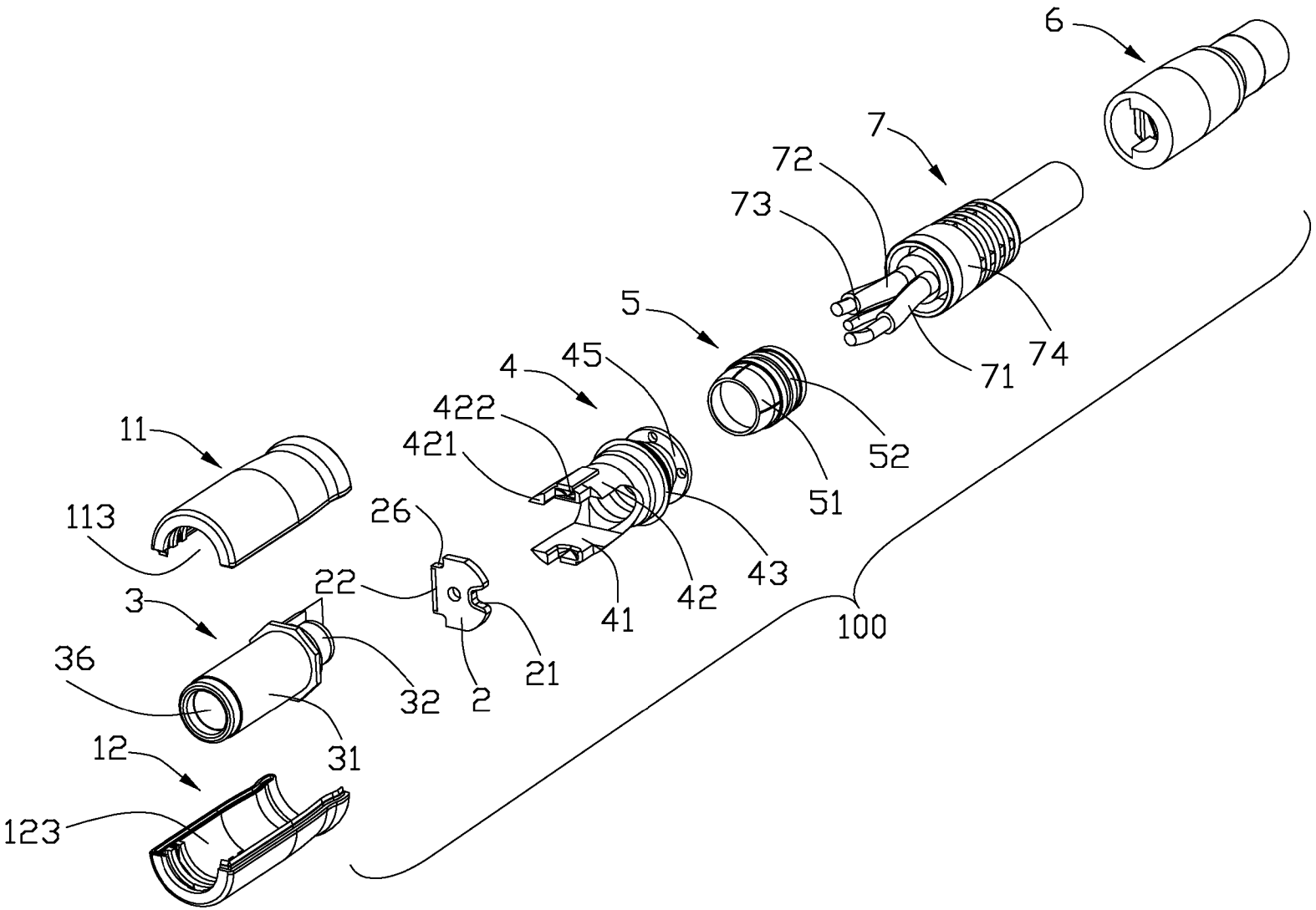
FIG. 2 is an exploded, perspective view of the cable connector assembly shown in FIG. 1.

Referring to FIGS. 1-2, a cable connector assembly 100 made in accordance with the present invention comprises a printed circuit board 2 perpendicular to a mating direction, a cylindrical mating member 3, a light pipe 4, a cable 7 with a plurality of wires, and an insulative shell 1 enclosing the aforementioned components.

Figure 3:
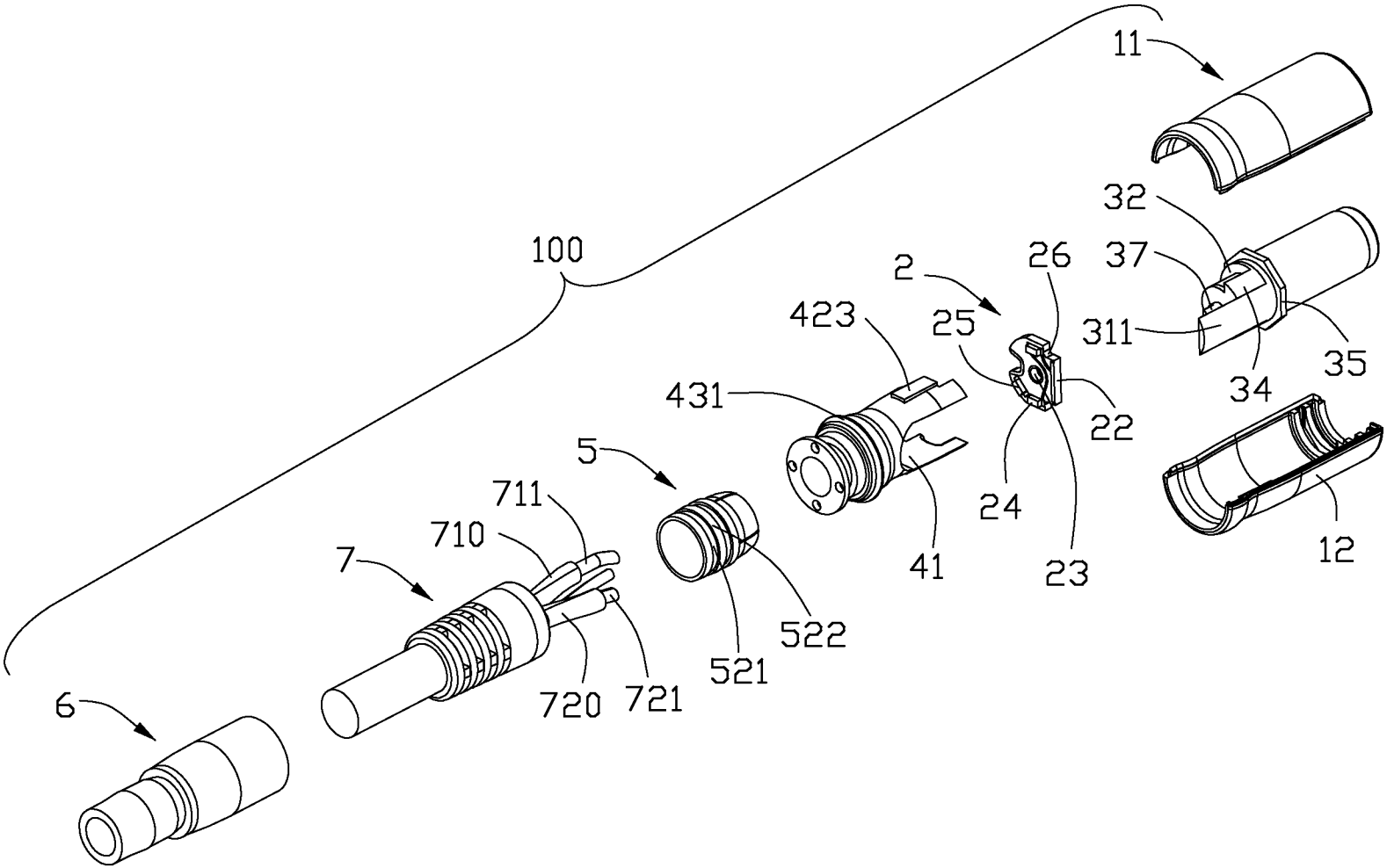
FIG. 3 is a view similar to FIG. 2, but viewed from a different angle.
Figure 4:
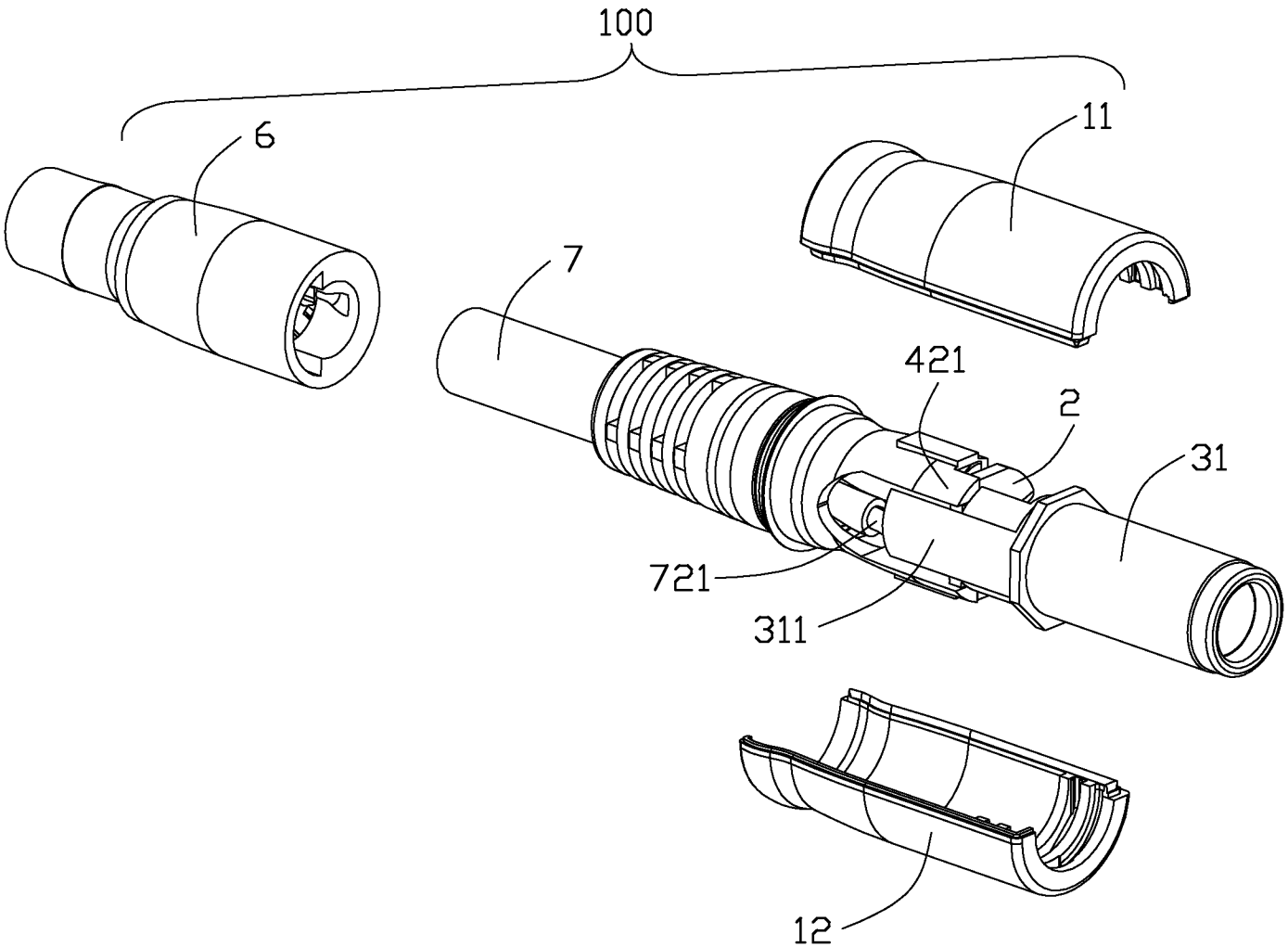
FIG. 4 is a partially assembled, perspective view of the cable connector assembly shown in FIG. 3.
Figure 5:
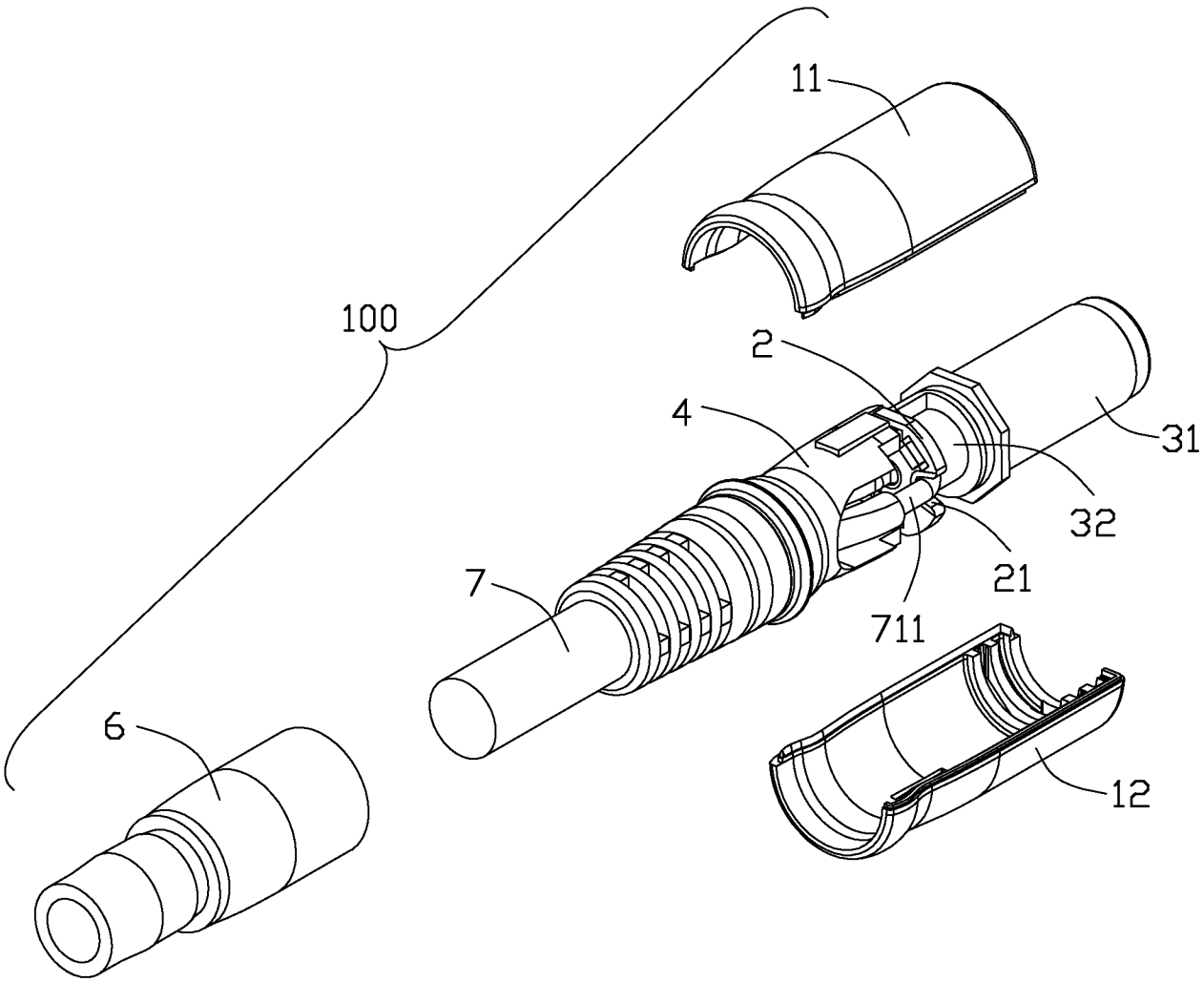
FIG. 5 is a view similar to FIG. 4, but viewed from a different angle.

Referring to FIGS. 2-4, the insulative shell 1 has a hollowed configuration with a cylindrical shape, and is configured with a top shell 11 and a bottom shell 12. The top shell 11 defines a first semicircular hole 113 recessed upwardly, the bottom shell 12 is symmetrical to the top shell 11 in shape, the bottom shell 12 has a second semicircular hole 123 together with the first semicircular hole 113 to form a circular hole.

The printed circuit board 2 is arranged in the insulative shell 1 along a direction vertical to the mating direction, the mating member 3 and the cable 7 are located on opposite sides of the printed circuit board 2. The printed circuit board 2 comprises a first conductive area 21 and a second conductive area 22 disposed on opposite edges thereof, the first conductive area 21 is arranged in an aperture (not numbered), and the second conductive area 22 is disposed on an upright side. The first and second conductive areas 21, 22 can be defined with other shapes in other alternative embodiments, such as a curved shape or round in shape. The printed circuit board 2 also has a central hole 23 defined through a center thereof, a pair of Light Emitting Diodes (LED) 24 used for indicating the work status of the cable connector assembly 100 and a resistor 25. The printed circuit board 2 defines a pair of outlets 26 on opposite sides thereof, and the outlets 26 are neighboring to the second conductive area 22 of the printed circuit board 2.

The cylindrical mating member 3 comprises a hollowed mating section 31 in a front end thereof, a polygonal flange 35 surrounding the cylindrical mating member 3, and a positive tube 32 located behind the polygonal flange 35 and communicated with an inner wall 36 of the cylindrical mating member 3. The mating section 31 serves as a negative portion of the mating member 3 and is isolated from the positive tube 32 by an insulator 34. The insulator 34 defines a through hole (not shown) in a center axis thereof along the pluggable direction, the through hole is aligning with the central hole 23 of the printed circuit board 2 along the mating direction. A detective contact 37 is disposed in the through hole, and a tail portion of the detective contact 37 is extending beyond a rear end of the insulator 34. A linking portion 311 is extending backwards from the mating section 31 on the side corresponding to the second conductive area 22 of the printed circuit board 2.

The light pipe 4 is of fork-shape, and used for transmitting the light from the LED 24. The light pipe 4 is also a hollowed configuration and defines two U-shaped cutouts 41 through the light pipe 4 along a direction perpendicular to the mating direction, and a pair of parallel protrusions 42 are formed on both sides of the cutouts 41. The protrusions 42 are adjacent to the LEDs 24 of the printed circuit board 2. Each protrusion 42 defines a leg portion 421 protruding forwards from a front end thereof, and the leg portions 421 are disposed on a side corresponding to the outlets 26.

The light pipe 4 also has a sleeve portion 43 connecting with the protrusions 42, and a visible area 431 is formed on an end of the sleeve portion 43 to indicate the status of the LEDs 24 for users looking at. A block member (not shown) is inserted into the light pipe 4 through the cutouts 41 to prevent the melted insulative material from reaching the LED 24 on the printed circuit board 2 when a strain relief is injection molded over the cable. The protrusions 42 are vertical to the printed circuit board 2 in the cable connector assembly 100, each protrusion 42 has a recess 422 in the surface towards the printed circuit board 2, and the recesses 422 are aligning with the LEDs 24 respectively. Each protrusion 42 defines a slick arc surface on an exterior side and a slick plane on an interior side, so to make the light to the protrusions 42 homogeneous. Each protrusion 42 defines a gibbous block 423 on the exterior side thereof to be received in the groove (not shown) of the insulative shell 1. Additionally, a matching portion 45 is defined on a back end of the sleeve portion 43.

The ring member 5 is made of plastic material with light color, and includes a slick loop portion 51 on a front end thereof and a retaining portion 52 behind the loop portion 51, said retaining portion 52 is defined with a rugged exterior surface. The retaining portion 52 has a larger length than the loop portion 51, and the retaining portion 52 defines a plurality of tubers 522 and a plurality of channels 521 alternately. Said loop portion 51 has an external diameter becoming more and more large along a front-to-back direction, so as to the ring member 5 can be inserted into the light pipe 4 easily. And said tubers 522 have bigger external diameters than the loop portion 51 on a rear end thereof.

The cable 7 comprises a fuscous strain relief portion 74 for releasing stress, a positive wire 71 and a negative wire 72 extending forwardly from the strain relief portion 74, and a middle wire 73 located between the positive wire 71 and negative wire 72, and the middle wire 73 is connected and soldered with the detective contact 37. The positive wire 71 and negative wire 72 respectively have inner conductors 711, 721 and outer jackets 710, 720 with part of the corresponding outer jackets 710, 720 stripped away from front ends thereof.

Referring to FIGS. 2-4, in assembling, the cylindrical mating member 3 is electrically connected with the cable 7, the detective contact 37 is accommodated in the through hole of the mating member 3 and inserted into the central hole 23 of the printed circuit board 2, then the middle wire 73 is soldered to the detective contact 37. The inner conductor 711 of the positive wire 71 is soldered to the first conductive area 21 of the printed circuit board 2, and a front end of inner conductor 711 is soldered to the positive tube 32 of the mating member 3. The linking portion 311 of the mating member 3 is soldered to the second conductive area 22 of the printed circuit board 2, and the inner conductor 721 of the negative wire 72 is soldered to the linking portion 311. The light pipe 4 is closed in insulative shell 1 with the gibbous blocks 423 received in the grooves of the insulative shell 1. The leg portions 421 of the light pipe 4 are inserted into the outlets 26 of the printed circuit board 2, to prevent the light pipe 4 from rotating or moving relative to the printed circuit board 2 and protect the LEDs 24 while an inner cover 6 molded. The LEDs 24 are aligning with the recess 422 of the protrusions 42 and received therein, the light pipe 4 is enclosing the electrical connection between the cable 7 and the detective contact 37.

The loop portion 51 of the ring member 5 is located in the light pipe 4 and arranged neighboring to an internal wall of the light pipe 4, and the retaining portion 52 is located out of the light pipe 4. The ring member 5 is enclosed in the strain relief portion 74 of the cable 7. When the strain relief portion 74 is over-molded onto the ring member 5, as the retaining portion 52 of the ring member 5 has an enough length with tubers 522 and channels 521 in stagger relationship, such configuration can enhance the engagement between the ring member 5 and the strain relief portion 74, so the cable connector assembly 100 can work longer normally.

Then the top shell 11 is assembled to the bottom shell 12 to enclose the mating member 3 and other components mentioned formerly, the visible area 431 of the light pipe 4 is exposed out of the insulative shell 1 to indicate the work status of the cable connector assembly 100. Thus, the cable connector assembly 100 is assembled.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

a mating member;

a printed circuit board with a LED;

a cable having a plurality of wires and connected with the mating member;

a light pipe having a pair of protrusions parallel to each other, and the protrusions neighboring to the LED; and an insulated shell enclosing the cable and the mating member, the printed circuit board disposed in the insulative shell;

wherein each protrusion has a leg portion protruding forwards from a front end thereof, and the printed circuit board defines a pair of outlets on opposite sides thereof to engage with the corresponding leg portions;

wherein the outlets are defined neighboring to one side of the printed circuit board;

wherein the protrusions are perpendicular to the printed circuit board, at least one of the protrusions has a recess towards the printed circuit board, and the recess is aligned with the LED on the printed circuit board; and wherein the mating member and the cable are located on opposite sides of the printed circuit board.

2. The cable connector assembly as claimed in claim 1, wherein the light pipe is of fork shape, and comprises a sleeve portion and a cutout through the light pipe along a direction perpendicular to a mating direction, and the protrusions are formed on both sides of the cutout.

3. The cable connector assembly as claimed in claim 1, wherein the cable connector assembly further comprises a ring member, the ring member includes a loop portion on a front end thereof and a retaining portion behind the loop portion, said retaining portion has a larger length than said loop portion, said retaining portion defines a plurality of tubers and channels in stagger relationship.

4. The cable connector assembly as claimed in claim 3, wherein said loop portion has an external diameter becoming more and more large along a front-to-back direction, and at least one of said tubers has a bigger external diameter than a rear end of the loop portion.

5. The cable connector assembly as claimed in claim 1, wherein the printed circuit board defines a first conductive area and a second conductive area disposed on opposite edges thereof, the first conductive area is arranged in an aperture, and the second conductive area is disposed on an upright side of the printed circuit board.

6. The cable connector assembly as claimed in claim 1, wherein the cable connector assembly further comprises a detective contact connecting with the cable, said detective contact is received in a through hole of the mating member and has a part extending beyond the printed circuit board and inserted into a central hole of the printed circuit board.

7. The cable connector assembly as claimed in claim 1, wherein an inner cover is molded on the light pipe and the printed circuit board.

8. The cable connector assembly as claimed in claim 1, wherein the outlets are neighboring to the second conductive area of the printed circuit board.

9. A cable connector assembly comprising:

a mating member forwardly communicating with an exterior in a mating direction;

a PCB (printed circuit board) located behind the mating member in said mating direction and extending in a vertical plane perpendicular to said mating direction;

an LED (Laser Emitting Diode) mounted upon the PCB;

a light pipe located behind the PCB with a forwardly protruding leg engaged within a notch formed in the PCB so as to restrict relative transverse movement therebetween perpendicular to mating direction;

a cable having wires extending through the light pipe and mechanically and electrically connected to the PCB;

wherein at least one of said wire extends through another notch of the PCB to connect to a front surface of the PCB;

wherein the forwardly protruding leg perpendicular to the printed circuit board and has a recess towards the printed circuit board, wherein the recess is aligned with the LED on the printed circuit board; and wherein the mating member and the cable are located on opposite sides of the printed circuit board.

10. The cable connector assembly as claimed in claim 9, wherein an insulative shell encloses the mating member, the PCB, the light pipe and a front portion of the cable.

* * * * *